United States Patent [19]

Ali Khan et al.

[11] Patent Number: 4,548,856

[45] Date of Patent: Oct. 22, 1985

[54] METHOD FOR FORMING SOFT, BULKY ABSORBENT WEBS AND RESULTING PRODUCT

[75] Inventors: Mir I. Ali Khan; Richard J. Schmidt, both of Appleton, Wis.

[73] Assignee: Kimberly-Clark Corporation, Neenah, Wis.

[21] Appl. No.: 643,582

[22] Filed: Aug. 22, 1984

Related U.S. Application Data

[62] Division of Ser. No. 495,225, May 16, 1983, Pat. No. 4,488,928.

[51] Int. Cl.[4] ..... B32B 5/14

[52] U.S. Cl. ..... 428/171; 156/209; 156/247; 156/296; 156/323; 428/156; 428/195; 428/288; 428/296; 428/373; 428/913

[58] Field of Search ..... 428/195, 198, 288, 156, 428/171, 296, 913, 373; 156/209, 323, 247, 296

[56] References Cited

U.S. PATENT DOCUMENTS

| | | | |
|---|---|---|---|
| 2,464,301 | 3/1949 | Francis | 428/171 |
| 2,537,126 | 1/1951 | Francis | 428/171 |
| 4,007,071 | 2/1977 | Addee et al. | 156/209 |
| 4,103,058 | 7/1978 | Humlicek | 428/171 |
| 4,443,513 | 4/1984 | Meitner et al. | 428/195 |
| 4,476,175 | 10/1984 | Forry et al. | 428/171 |
| 4,493,868 | 1/1985 | Meitner | 428/195 |

*Primary Examiner*—James J. Bell
*Attorney, Agent, or Firm*—William D. Herrick

[57] ABSTRACT

Improved method and apparatus for forming soft, bulky absorbent webs including thermoplastic fibers. The web is bonded under conditions that heat the thermoplastic fibers to produce web bonding while avoiding direct contact with the heat source. The apparatus includes a pair of foraminous belts or wires between which the web or webs to be bonded are enclosed. The construction of the foraminous wires and belts is selected to produce the desired degree of bonding and yet maintain separation between the subsequently applied heat source and the web or webs. The combination of the web and belts or wires is then directed under tension to a heat source which may be, for example, a series of heated cans, and the opposite sides of the combination are alternately contacted by the surfaces. After heating, the web is allowed to cool and retains its bonded configuration determined by the structure of the wires or belts and the content of the web. Examples of webs which may be so bonded include pulp fluff having mixed therein thermoplastic bonding fibers such as polypropylene/polyethylene biconstituents, for example, Chisso ES. The construction of the belt or wires preferably is such that at least about 20% open area is provided upon contact with the web for sufficient strength properties to be obtained. In alternative embodiments, multiple webs of the same or different compositions may be fed between the wires or belts and laminates produced. Webs of the invention retain highly desirable absorbency properties since the open structure is maintained to a high degree by avoiding direct contact with the heat source that would otherwise produce excessive fusing and overbonding of the webs.

12 Claims, 16 Drawing Figures

METHOD FOR FORMING SOFT, BULKY ABSORBENT WEBS AND RESULTING PRODUCT

This is a divisional of co-pending application Ser. No. 495,225 filed on May 16, 1983 now U.S. Pat. No. 4488928.

BACKGROUND OF THE INVENTION

1. Field of the Invention

The present invention relates to the manufacture of soft, bulky nonwoven webs intended primarily for use in absorbent products. The manufacture of nonwoven webs has been accomplished by a variety of processes. Most of these involve the formation of fibers and filaments which are collected, usually in a more or less random array, and bonded. A wide variety of bonding steps has been developed depending upon the composition of the web, desired end use and other factors. These bonding steps include application of adhesives in a pattern or overall manner, and activation of adhesive fibers either chemically, for example, by solvent treatment, or by the use of heat and pressure to cause thermoplastic fibers to bond. Where the web contains thermoplastic fibers, widespread application has been made of the heat and pressure bonding process. In many cases, this provides high speed, low cost operation and, particularly when pressure is applied in a pattern, produces fabric-like properties. The present invention is directed to improvements in such processes and apparatus and products particularly adapted for uses requiring bulky, soft and very absorbent materials including thermoplastic fibers.

2. Description of the Prior Art

Thermoplastic fiber nonwoven webs are well known and described in a number of patents of which U.S. Pat. No. 4,041,203 to Brock and Meitner issued Aug. 9, 1977 is an example. It is also known to produce webs of mixtures of thermoplastic and nonthermoplastic fibers. Examples of such materials are disclosed in U.S. Pat. No. 4,307,721 to Tsuchiya and Mizutani dated Dec. 29, 1981; Canadian Pat. No. 1,012,420 to Marshall dated June 21, 1977; and U.S. Pat. No. 4,100,324 to Anderson, Sokolowski, and Ostermeier issued July 11, 1978. It is further known to use belts and wires for the formation of nonwoven webs, and U.S. Pat. No. 4,071,925 to Folk issued Feb. 7, 1978, U.S. Pat. No. 3,729,374 to Lissalde issued Apr. 24, 1973, U.S. Pat. No. 4,095,312 to Haley issued June 20, 1978 and U.S. Pat. No. 4,209,563 to Sisson dated June 24, 1980 are examples of teachings of such processes and apparatus. However, it remains desired to further improve such methods and apparatus, particularly as applicable to the production of bulky, soft, absorbent webs for applications in products such as sanitary napkins, disposable diapers, and the like. Existing methods and apparatus tend to result in overbonded webs reducing the effective absorbency and adversely affecting tactile and bulk properties.

SUMMARY OF THE INVENTION

The present invention is directed to improvements in methods and apparatus for forming nonwoven webs and laminates containing thermoplastic fibers or filaments as well as the resulting products. In accordance with the present invention, the initial web forming step may be any of those known to the art which produces a relatively uncompressed batt, or combination of batts, films or nonwovens in the case of laminates, containing a mixture including thermoplastic fibers. For example, the meltblown process combined with pulp fibers as described in the abovementioned U.S. Pat. No. 4,100,324 to Anderson, Sokolowski, and Ostermeier issued July 11, 1978 may be employed as well as conventional carding, picking, and airlaying steps. This relatively weak, unbonded web, in accordance with the present invention, is then contained between a pair of traveling, foraminous wires or belts. The selection of these wires or belts is essential to the present invention and involves a combination of at least about 20% and up to about 80% open area, filament configuration, and filament diameter necessary to produce the desired web properties. While contained between these wires or belts, the web is subjected to heat under conditions where direct contact with the heat source is avoided due to the intervening belts. The heat source may be any of a variety of means, including, for example, heat cans or through air dryers, but is preferably a means that prevents undue compression of the belt and web combination. After heating, the thermoplastic fibers produce bonding of the web in a pattern corresponding to the wire or belt structure. By selection of the wire or belt configuration, properties of the web such as strength and bulk may be directly controlled. In accordance with the invention the resulting webs are pattern bonded with areas of high bulk and low compression which produce very desirable tactile and absorbency properties. Alternative embodiments include forming laminates by combining a plurality of webs and/or including one or more films between the wires or belts. In all cases, the resulting materials are characterized by high bulk and softness resulting from bonding produced by the lower melting fibers and a pattern of higher bond strength areas produced by the design of the belts.

DESCRIPTION OF THE PREFERRED EMBODIMENTS

Figure 1:
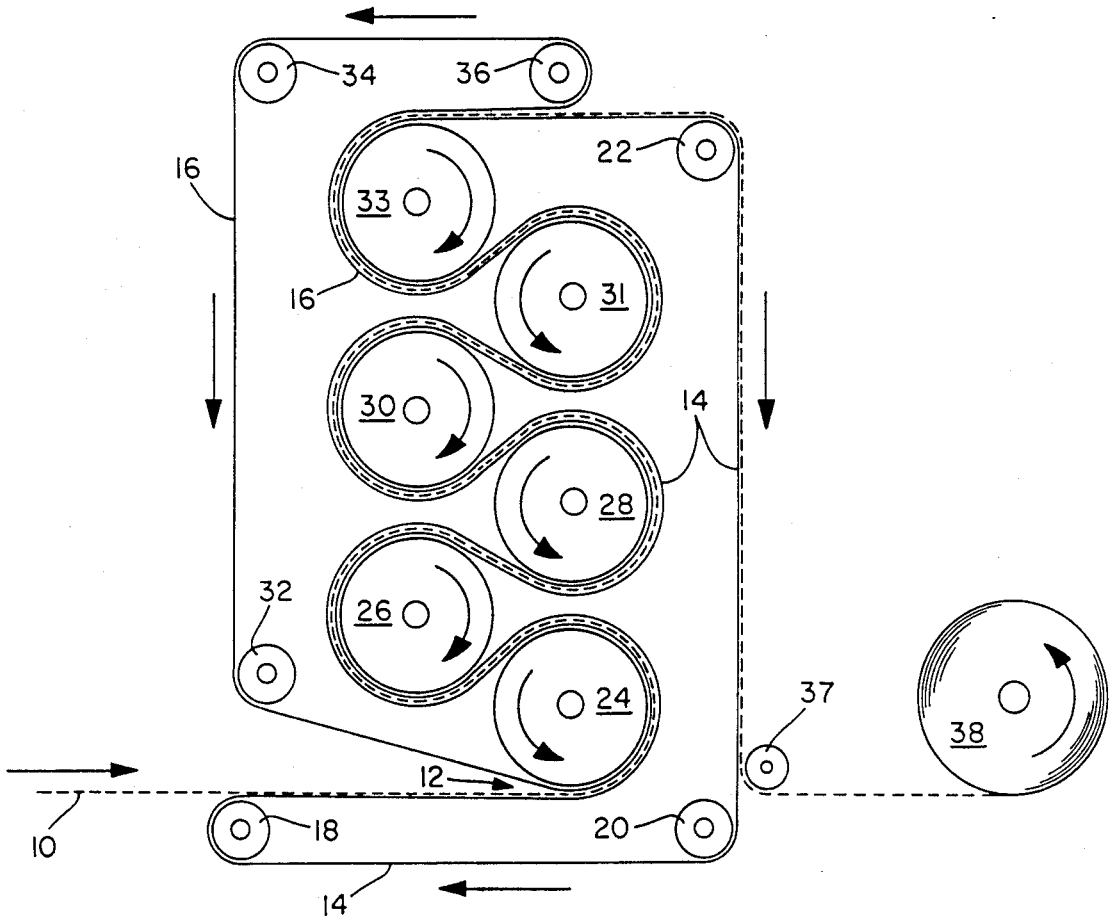
FIG. 1 is a schematic, cross-sectional view of one form of apparatus for carrying out the present invention.

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

The composition of webs produced in accordance with the invention may vary widely. It is important, however, that the web contain sufficient thermoplastic low melt fibers to achieve the desired degree of bonding. This will be determined by the end use intended for the web, but, generally, will be at least 10% by weight and, preferably 20% to 40% so that the strength will be at least sufficient to maintain an integrated web as a component of products such as sanitary napkins and disposable diapers and will be significantly stronger for more demanding applications such as disposable wipers and the like. The particular low melt thermoplastic fibers may also vary widely and will be selected from single and milticomponent fibers based on the desired end use properties and cost. Examples include polyolefins such as polyethelene (Short Stuff TM from Mini Fibers, Inc.) and polypropylene, lower melting point polymers such as a bicomponent polyolefin fiber described as Chisso ES available from Chisso Corporation, polyester such as Kodel TM 410 (BA) and 438 (BC) as well as duPont Dacron TM D-134 and D-611, copolyamides from Grilon (SA) and vinyl chloride/vinyl acetate copolymers designated Wacker "MP" from Wacker-Chemie (Germany) for example, and others. It will be recognized that, in certain cases, the material may comprise two different thermoplastic polymer fibers wherein one has a lower melting point to be utilized for bonding purposes. In other cases, the nonthermoplastic fiber component may be selected from a wide variety of materials including natural fibers such as cotton, rayon and wood pulp as well as synthetic fibers such as polyolefins, polyesters, polyamides and the like.

Formation of the starting web to be processed in accordance with the invention may be made using a number of known processes such as conventional carding equipment, for example. Preferred are those methods which result in a generally uniform blend of the thermoplastic bonding fibers within the other web fiber components and produce a low density, bulky batt or web. Other examples include carding, picking and doffing apparatus as well as airlaying apparatus. In general, such equipment separates the fibers and redistributes them in a air stream with turbulent mixing and deposition on a collecting surface. Examples of such processes and apparatus are described in U.S. Pat. No. 3,692,622 to Dunning issued Sept. 19, 1972, U.S. Pat. No. 2,447,161 to Coghill issued Aug. 17, 1948, U.S. Pat. No. 2,810,940 to Mills issued Oct. 29, 1957, and British Pat. No. 1,088,991 to G. B. Harvey published Oct. 25, 1967. An example of a process using thermoplastic fibers is described in the abovementioned U.S. Pat. No. 4,100,324 to Anderson, Sokolowski and Ostermeier issued July 11, 1978. It will be recognized that the webs may also include other ingredients such as filters, surfactants, pigments and the like, depending upon the intended end use.

The basis weight may also vary within a wide range from very light cover stock material to heavy absorbent pads and wipers. In general, however, useful commercial webs will be in the range of from about 15 to about 150 grams per square meter, more especially about 15 to about 50 grams per square meter. Heavier webs may be made at higher temperatures and/or slower speeds.

Figure 2:
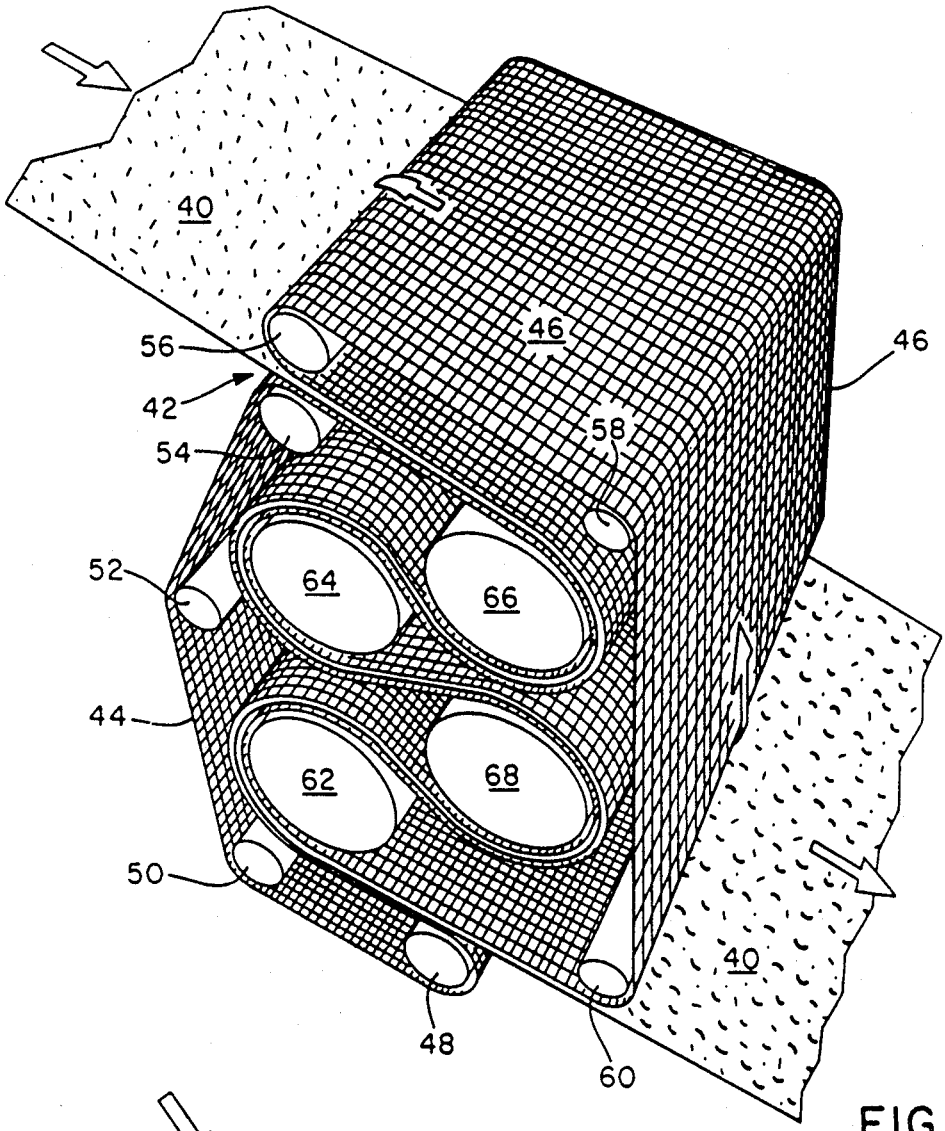
FIG. 2 is an alternative embodiment shown in schematic perspective.
Figure 3:
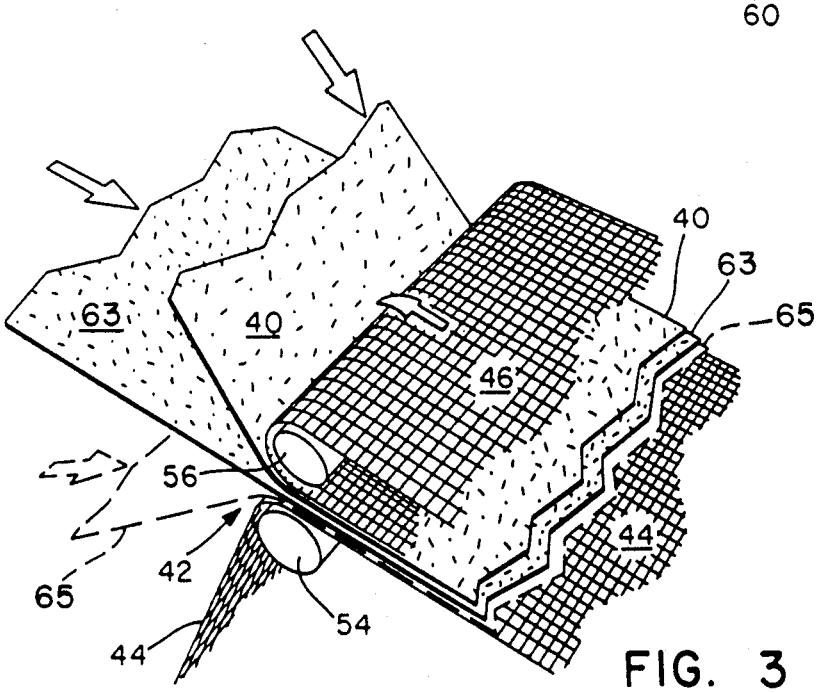
FIG. 3 is a partial view of the arrangement of FIG. 2 used for combining multiple webs.

Turning to FIG. 1, the process of the invention will now be described in detail. Base web 10 is provided and directed to nip 12 between belts 14 and 16. Belt 14 travels about idler and/or guide rolls 18, 20 and 22 and hot cans 24, 26, 28, 30, 31 and 33. Belt 16 travels about idler and/or guide rolls 32, 34 and 36 and also about the hot cans. The combination of the web and belts is, therefore, directed in contact with the successive heating cans on alternating belt surfaces. In this manner, web 10 is heated through the belts equally on both sides. The number of heating cans will vary depending upon the time required for bonding as well as the temperature. For example, in a laboratory scale setup, where Chisso ES bonding fibers are used in a 20 g/m$^2$ web, and the web is traveling at a speed of about 20 ft/min, the number of heating cans of a diameter of 23 in. required may be such as to produce a contact time as high as about 70 sec. to obtain a bonded structure. Higher speed operations will, of course, be possible with commercial scale equipment. It will be recognized that the selection of factors such as heating time and temperature, belt tension as well as web composition may be varied to produce desired results. In the case of belt tension, for example, an increase will improve web strength while reducing bulk. For purposes of driving the belt, it will be understood that one or more of the belt rolls 18, 20, 22, 32, 34 and 36 may be driven. After heating, web 10 is separated from the belts 14 and 16 and directed to a station where it may be either wound into roll 38 or converted into sheets, pads, or end use products. If desired the web may be cooled after bonding by contact with chilled rolls (not shown) or the like. The tension on the belts is important and must be maintained at a level sufficient to produce the desired degree of bonding while avoiding undue web compression. For most purposes, this will be in the range of from about 3 pli to 10 pli and preferably in the range of from about 3 pli to 5 pli to produce bulky and soft webs of sufficient integrity for use as components of sanitary napkins and disposable diapers as well as wipers, for example. FIG. 2 is a schematic perspective view of an alternative arrangement wherein base web 40 enters from the top to nip 42 between belts 44 and 46 turning on rolls 48, 50, 52, 54, 56, 58 and 60. In this case four hot cans 62, 64, 66 and 68 are used. FIG. 3 illustrates how the apparatus of FIG. 2 can be used to combine two or more webs 63 and 65 with web 40. In the case of laminates, it may be necessary to use an extended heating time depending upon the nature of the laminates and the combined weight. The composition of the individual webs to be combined may be the same or different to produce desired properties and, if desired, one or more of the webs may be a film.

Figure 4:
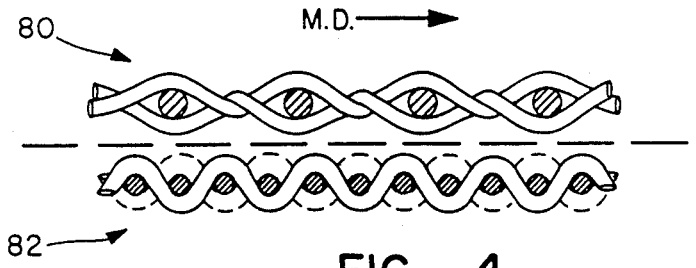
FIGS. 4–7 illustrate combinations of belts useful in accordance with the invention.
Figure 5:
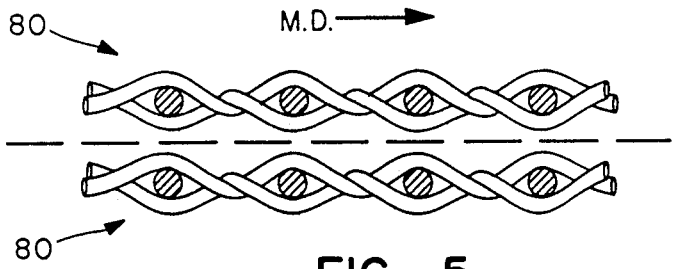
Figure 6:
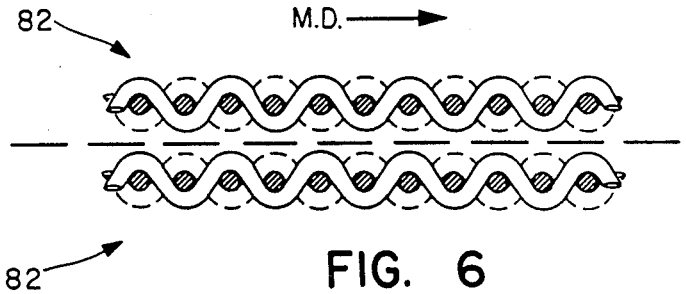
Figure 7:
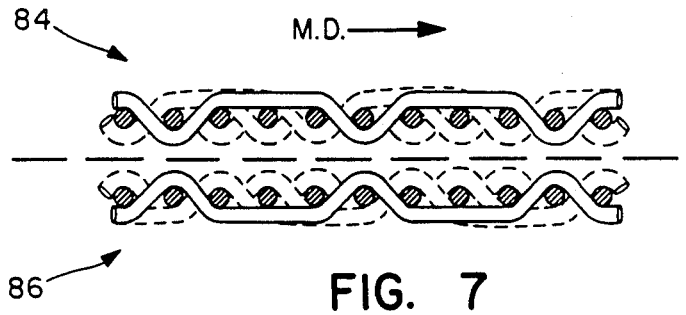
Figure 8:
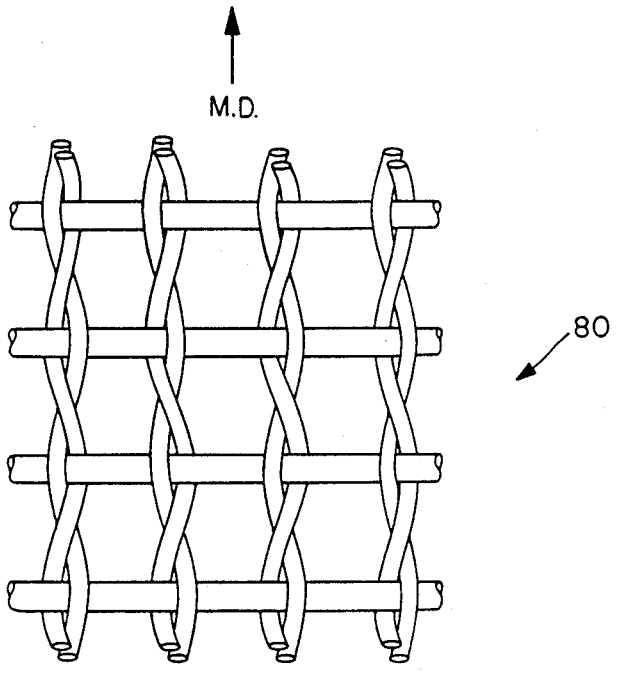
FIGS. 8–11 further illustrate the weaves of such belts.
Figure 10:
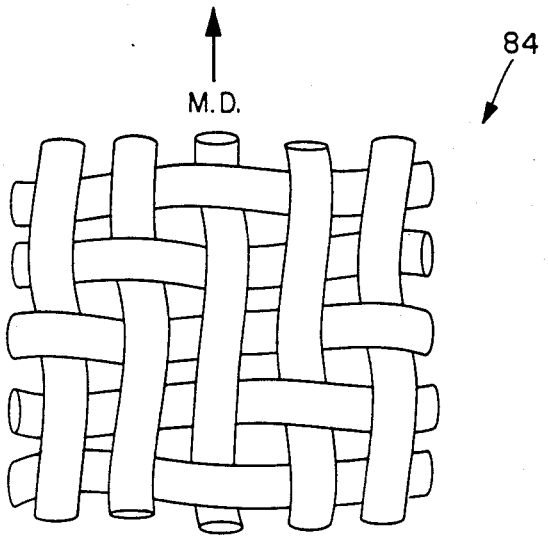
Figure 11:
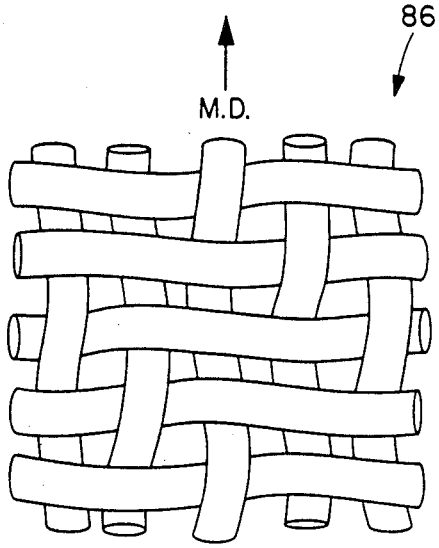
Figure 12:
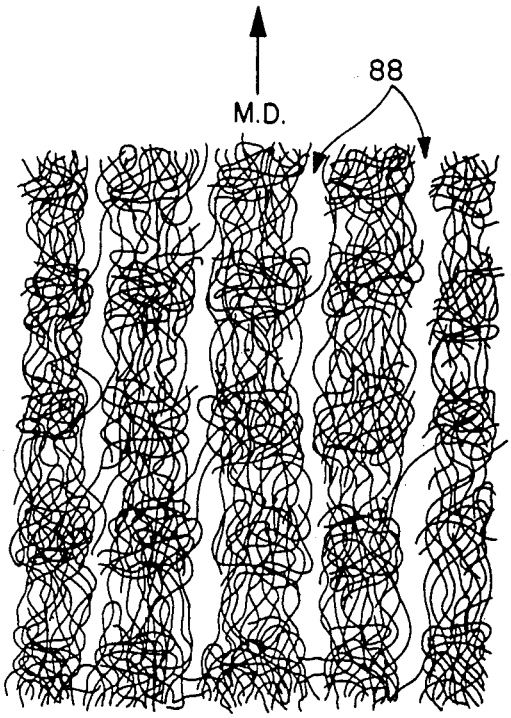
FIGS. 12–15 illustrate various web patterns obtained with the belt combinations of FIGS. 4–7.
Figure 13:
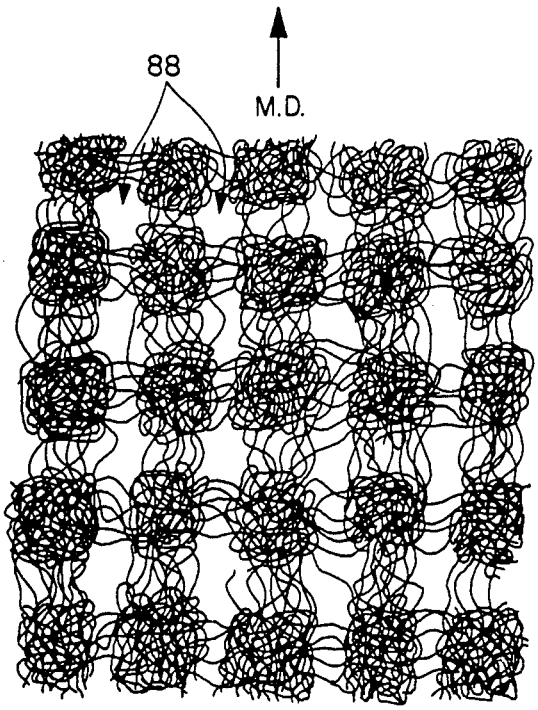
Figure 14:
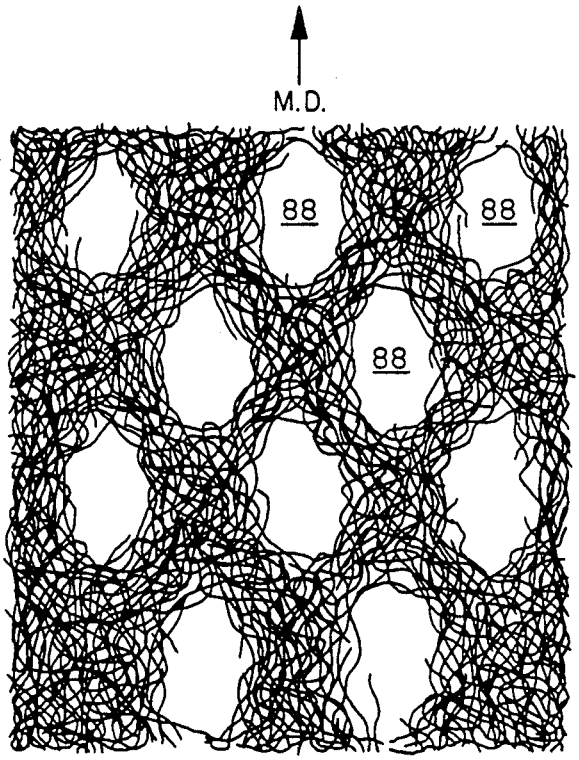
Figure 15:
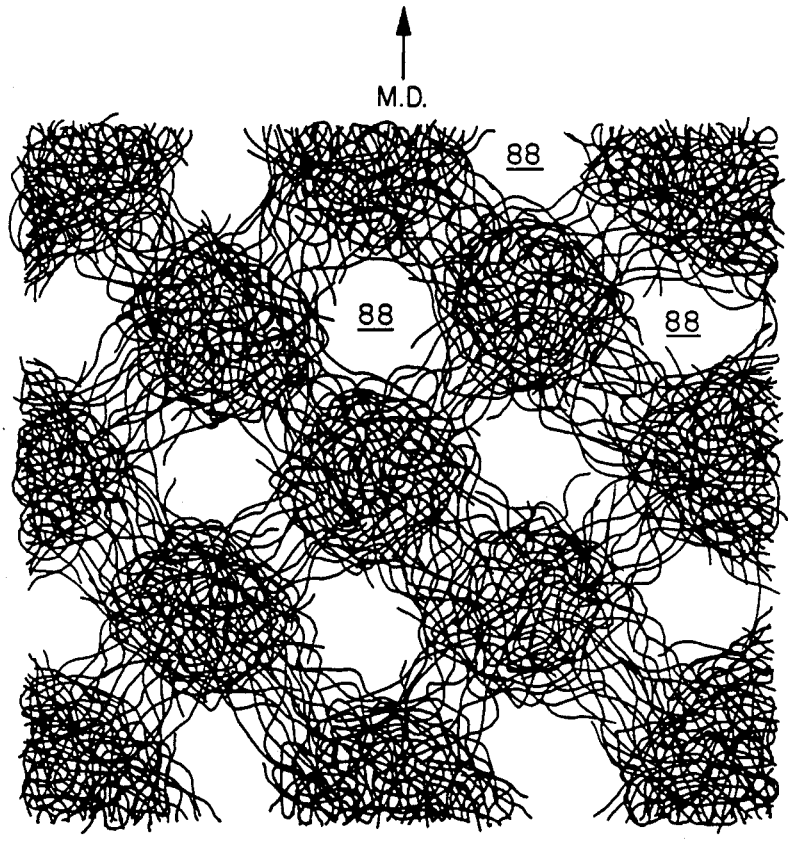

FIGS. 4–7 illustrate several combinations of belt weaves useful in accordance with the invention. The weaves are further illustrated in perspective views FIGS. 8–11. FIG. 8 shows a leno weave 80, FIG. 9 a plain weave 82, FIG. 10 a twill weave 84 (long knuckle up) and FIG. 11 the reverse twill weave 86 (long knuckle down). These weaves and belts as well as others which may be used are of known construction and commercially available. FIG. 4 schematically illustrates an embodiment using a combination of a leno weave belt 80 and a plain weave belt 82. The resulting web is shown in FIG. 12 wherein the light areas 88 represent densified knuckle areas which may be apertures in lighter basis weight webs. FIGS. 5 and 13 are similar representations for a combination of two leno weave belts. FIGS. 6 and 14 similarly show the combination of two plain weave belts, and FIGS. 7 and 15 for the combination of twill weave belts. As these drawings demonstrate, a virtually unlimited number of patterns may be achieved by varying the belt weaves and combinations. As shown in all cases, the imprint of the belt is clearly defined as a bond pattern although the areas within the defined pattern remain substantially unbonded and bulky. The surface pattern of the open mesh belt or wire is important. The surface will form impressions in the web at the points where fibers melt on surface contact between the heat source and the wire or belt.

Figure 16:
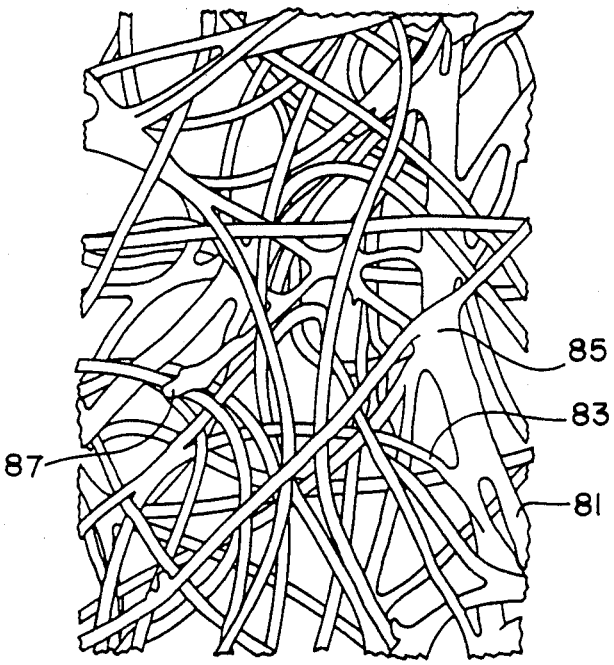
FIG. 16 illustrates a cross-section of a web impression area in greater detail.

FIG. 16 is a greatly enlarged representation of a cross-section of a bond area showing low melt bicomponent fibers 81 and high melt fibers 83. Area 85 can be identified where two low melt fibers bond, and areas 87 exist where low and high melt fibers bond. Even in this bond area, however, it is clear that the fibrous integrity is substantially maintained, and the fibers are not completely melted or fused. In this case twill weave belts were used as in FIG. 7. The degree of bonding will depend on the amount of bonding fibers, type of fibers, basis weight, tension applied, and the weave, caliper, open area, texture (ends) and (picks) and release properties of the belt or wire. Each belt or wire should have at least about 20% and up to 80% open area, preferably about 35% to 70%. The means for heating the web and belt or wire combination may be other than the heating cans illustrated. For example, a through air arrangement may be employed wherein hot air is directed through the wire and web combination.

EXAMPLES

EXAMPLE 1

A web was formed of 70% polyethylene terephthalate fibers (nominal 1½ denier, 1½ inch length) and 30% Chisso-ES fibers by blending on a card machine, Hergeth model WZM/K5. This web had a basis weight of 20 grams per square meter and was directed between a dual wire system, each of which was a Leno weave belt formed of Nomex warp and fiberglass filling (shute) filaments having a 6×6 mesh as shown in FIG. 8. The belt was maintained at a tension of 3 pli and the combination directed over a series of six heating cans having a diameter of 23 in. and maintained at a temperature of 300° F. to provide a contact time of about 35 sec. with each side of the belt/web combination.

EXAMPLE 2

Figure 9:
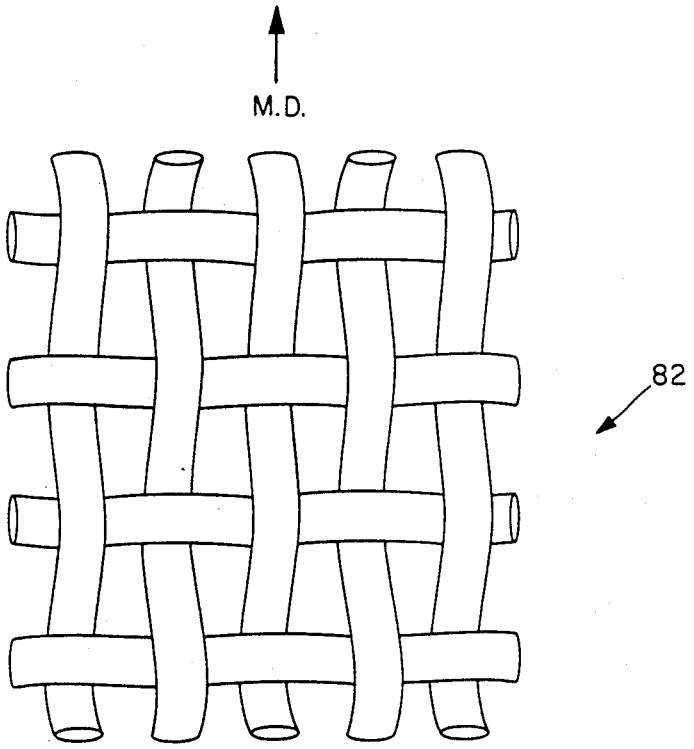

Example 1 was repeated except that the belts employed were plain weave polyester monofilament, both warp and filling (shute), with a 22×12 mesh as shown in FIG. 9. The material in this case has a basis weight of 18.6 grams per square meter.

EXAMPLE 3

Example 1 was repeated except that the web was 7.0% Hercules type 123 polypropylene (nominal 1½ denier, 1½ inch length) and 30% Chisso-ES biocomponent fibers and had a basis weight of 21.3 grams per square meter.

EXAMPLE 4

Example 3 was repeated except that the polypropylene was Hercules type 151 polypropylene and the belts were both Leno weave.

EXAMPLES 5 AND 6

Examples 3 and 4 were repeated except that the belts used were polyester belts as in Example 2.

EXAMPLE 7

Example 1 was repeated except that the web was 70% rayon and 30% Chisso-ES fibers with a basis weight of 20.5 grams per square meter.

EXAMPLES 8 AND 9

A heavier basis weight material was made by combining as in Example 1 an unbonded carded web (70% polypropylene #123 fibers, 30% Chisso ES fibers) having a basis weight of 18 gsm on both sides of a web of textile fibers identified as used fibers (Leigh Textile A1122, nominally ½"-1" staple 50/50 mixture of cotton and polyester fibers) for a combined weight of 50 gsm. The combination is useful as an industrial wipe, for example. This example was repeated substituting polyester staple fibers for the polypropylene fibers.

EXAMPLE 10

Another heavier basis weight material was formed by combining as in Example 1 an unbonded carded web of 18 grams per square meter containing 60% polyester (PET-T-41D) and 40% Chisso ES fibers with a fluff layer of 64 grams per square meter containing 85% southern softwood Kraft pulp and 15% pulpex by laying the pulp onto the carded web and thermally bonding as in Example 1. The resulting laminate is suitable as an absorbent material for feminine hygiene, disposable diapers and the like.

EXAMPLES 11–14

For comparison, similar tests were performed on webs bonded by calendering, pattern embossing, and throughdrying.

Examples 1 through 7 are summarized along with related test data in the Table.

TABLE

| Example | Web Composition | Basis Weight g/M² | Belt(s) | Bulk (in.) | Tensile (lbs/in) MD | Tensile (lbs/in) CD | % Elongation MD | % Elongation CD | Elmendorf Tear (g) MD | Elmendorf Tear (g) CD | Handle-O-Meter (g) MD | Handle-O-Meter (g) CD | Tensile Ratio MD:CD | Rewet PSI 0.25 | Rewet PSI 0.50 | Rewet PSI 1.0 |
|---|---|---|---|---|---|---|---|---|---|---|---|---|---|---|---|---|
| 1. | 70% Polyester<br>30% Chisso ES | 20.0 | Leno<br>Leno | 0.021 | 0.48 | 0.21 | 26.2 | 34.3 | 93 | 115 | 5.9 | 3.9 | 2.3:1 | 0.59 | 0.86 | 1.14 |
| 2. | 70% Polyester<br>30% Chisso ES | 18.6 | Plain<br>Plain | 0.028 | 0.59 | 0.12 | 24.8 | 33.0 | 64 | 67 | 5.6 | 3.7 | 5:1 | NA | NA | NA |
| 3. | 70% Polypropylene (T123)<br>30% Chisso ES | 21.3 | Leno<br>Leno | 0.022 | 1.1 | 0.5 | 16.8 | 22.7 | 122 | 150 | 15.3 | 10.5 | 2.2:1 | 0.18 | 0.32 | 0.61 |
| 4. | 70% Polypropylene (T151)<br>30% Chisso ES | 20.7 | Leno<br>Leno | 0.014 | 1.2 | 0.4 | 12.5 | 22.6 | 83 | 109 | 16.9 | 6.5 | 3.0:1 | 0.37 | 0.51 | 1.3 |
| 5. | 70% Polypropylene (T123)<br>30% Chisso ES | 20.9 | Plain<br>Plain | 0.017 | 1.7 | 0.6 | 16.3 | 17.7 | 102 | 125 | 17.1 | 7.6 | 2.8:1 | 0.62 | 0.78 | 0.95 |
| 6. | 70% Polypropylene (T151)<br>30% Chisso ES | 19.0 | Plain<br>Plain | 0.015 | 1.1 | 0.4 | 15.1 | 15.5 | 106 | 109 | 10.2 | 5.7 | 2.5:1 | 0.55 | 0.79 | 0.98 |
| 7. | 70% Rayon<br>30% Chisso ES | 20.5 | Leno<br>Leno | 0.018 | 0.57 | 0.14 | 13.1 | 30.8 | 80 | 74 | 7.3 | 2.7 | 4.1:1 | 0.99 | 1.19 | 1.31 |
| 8. | 70% Polypropylene/ | 50.0 | Leno | 0.040 | 10.0 | 5.8 | 22.6 | 27.7 | NA | NA | NA | NA | NA | NA | NA | NA |

TABLE-continued

| Example | Web Composition | Basis Weight g/M² | Belt(s) | Bulk (in.) | Tensile (lbs/in) MD | Tensile (lbs/in) CD | % Elongation MD | % Elongation CD | Elmendorf Tear (g) MD | Elmendorf Tear (g) CD | Handle-O-Meter (g) MD | Handle-O-Meter (g) CD | Tensile Ratio MD:CD | Rewet PSI 0.25 | Rewet PSI 0.50 | Rewet PSI 1.0 |
|---|---|---|---|---|---|---|---|---|---|---|---|---|---|---|---|---|
| | 30% Chisso; 100% Textile; 70% Polypropylene/ 30% Chisso | | Leno | | | | | | | | | | | | | |
| 9. | 70% Polyester/ 30% Chisso; 100% Textile; 70% Polyester/ 30% Chisso | 100.0 | Leno Leno | 0.057 | 12.1 | 5.8 | 16.3 | 24.7 | NA | NA | NA | NA | NA | NA | NA | NA |
| 10. | 60% Polyester/ 40% Chisso; 100% Fluff | 206.0 | Twill Twill | 0.123 | 2.0 | 1.1 | 13.8 | 15.6 | NA | NA | NA | NA | NA | NA | NA | NA |
| 11. | 70% Polyester 30% Chisso ES | 17.6 | Calendered Steel & Cotton Rolls | 0.006 | 2.17 | 0.69 | 33.6 | 28.3 | 160 | 202 | 4.5 | 4.6 | 3.1:1 | 1.40 | 1.84 | 2.09 |
| 12. | 70% Polyester 30% Chisso ES | 16.3 | Embossed Diamond Pattern | 0.014 | 1.38 | 0.32 | 25.1 | 36.4 | 106 | 118 | 4.1 | 3.7 | 4.3:1 | 0.70 | 1.09 | 1.4 |
| 13. | 70% Polyester 30% Chisso ES | 18.6 | Through Drying Under Wires | 0.011 | 1.07 | 0.28 | 10.4 | 16.6 | 109 | 99 | 10.1 | 6.3 | 3.8:1 | NA | NA | NA |
| 14. | 70% Polyester 30% Chisso ES | 21.5 | Thrudryer | 0.052 | 0.18 | 0.06 | 24.4 | 64.7 | 64 | 74 | 6.7 | 5.9 | 3:1 | 0.56 | 0.75 | 0.98 |

As the Table demonstrates, the method and apparatus of the invention produce a material having both high bulk and softness as well as sufficient strength for many applications. The stain data demonstrate the ability of the webs of the invention to pass blood through into a fluff layer below while resisting its retransmission. The smaller the stain area, of course, the better the web performs as a cover, and the "shadow" is best as indicating almost no stain. With the exception of Example 7 which contained rayon, a more hydrophilic fiber, webs of the invention resulted in significantly lower stain areas, generally. Also, the tendency to rewet under pressure is shown to be generally lower with webs of the invention. While it is not desired to limit the invention to any particular theory, it is believed that the improvements of the present invention are attained because heat applied to the bicomponent fiber web between the belts or wires causes the lower melting fiber to become progressively softer as the temperature increases. The lower melting fibers plasticize and, as long as the temperature does not exceed the plasticizing point of the higher melting fibers, the intermolecular bond of the lower melting fibers causes bonding to occur to the other fibers. In this manner, the bonding becomes localized to the areas where heat transfer occurs and permits substantial portions of the web to remain unbonded or only lightly bonded. Because these areas are not compressed, the high bulk, softness and other improved tactile properties are obtained.

Thus it is apparent that there has been provided in accordance with the invention, a method and apparatus and resulting product that fully satisfy the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. Method of bonding webs containing thermoplastic low melt fibers comprising the steps of:

(a) providing a pair of flexible foraminous traveling wires, each having a percent open area in the range of from about 20 to 80;

(b) bringing said wires together to form a nip;

(c) directing said web between said traveling wires at or prior to said nip;

(d) subjecting said combination of web and wires to heat to at least partially fuse said low melt fibers while maintaining tension on said wires; and (e) separating said web from said wires.

2. The method of claim 1 wherein said combination of web and wires is contacted with multiple heated drums contacting both wires separately so that opposite surfaces of said web are heated.

3. The method of claim 1 wherein said combination of web and wires is heated by a through air dryer.

4. The method of claims 1, 2 or 3 wherein said low melt thermoplastic fibers comprise bicomponent polyolefin fibers and are included in the range of from about 10% to 50% by weight.

5. The method of claim 4 wherein said wires have different weave configurations.

6. The method of claim 1 including the additional step of combining a second thermoplastic layer with said web prior to directing the web between said traveling wires.

7. The method of claim 1 wherein said tension is in the range of from about 3 to about 10 p.l.i.

8. A bulky, soft, nonwoven web comprising a mixture of fibers including at least about 10% by weight of low melting thermoplastic fibers fused without substantially destroying fiber identities to form inter-fiber bonds in a pattern of compressed areas corresponding to a knuckle wire pattern and relatively low density areas of substantially unbonded fibers outside said pattern formed by application of heat to the web under tension between two wires.

9. The web of claim 8 wherein said low melting fibers are bicomponent polyolefin fibers.

10. The web of claim 8 comprising a laminate bonded by means of said application of heat.

11. The web of claim 8 having a different pattern of compressed areas on opposing web surfaces.

12. The web of claim 8 wherein said low melting fibers are selected from the group consisting of single component fibers of polyolefins, polyesters, polyamides, and copolymers thereof.

* * * * *